US005395250A

United States Patent [19]

Englert, Jr. et al.

[11] Patent Number: 5,395,250

[45] Date of Patent: Mar. 7, 1995

[54] LOW PROFILE BOARD TO BOARD CONNECTOR

[75] Inventors: Michael W. Englert, Jr., Middletown; Donald J. Summers, Shiremanstown, both of Pa.

[73] Assignee: The Whitaker Corporation, Wilmington, Del.

[21] Appl. No.: 184,522

[22] Filed: Jan. 21, 1994

[51] Int. Cl.[6] ..... H01R 9/09

[52] U.S. Cl. ..... 439/65; 439/74; 439/83; 439/876

[58] Field of Search ..... 439/65, 74, 83, 876

[56] References Cited

U.S. PATENT DOCUMENTS

| | | | |
|---|---|---|---|
| 3,960,434 | 6/1976 | Soes | 339/176 M |
| 4,479,686 | 10/1984 | Hoshino et al. | 339/17 LC |
| 4,616,893 | 10/1986 | Feldman | 339/14 R |
| 4,655,519 | 4/1987 | Evans et al. | 439/74 |
| 4,678,121 | 7/1987 | Douty et al. | 439/610 |
| 4,734,060 | 3/1988 | Kawawada et al. | 439/660 |
| 4,869,677 | 9/1989 | Johnson et al. | 439/80 |
| 4,929,185 | 5/1990 | Wong et al. | 439/74 |
| 4,971,565 | 11/1990 | Fox, Jr. | 439/74 |
| 5,030,107 | 7/1991 | Moon | 439/62 |
| 5,057,027 | 10/1991 | Yamada et al. | 439/83 |
| 5,098,311 | 3/1992 | Roath et al. | 439/65 X |
| 5,104,324 | 4/1992 | Grabbe et al. | 439/62 |
| 5,116,247 | 5/1992 | Enomoto et al. | 439/660 |
| 5,145,384 | 9/1992 | Asakawa et al. | 439/83 X |
| 5,199,884 | 4/1993 | Kaufman et al. | 439/74 |
| 5,310,357 | 5/1994 | Olson | 439/346 |

FOREIGN PATENT DOCUMENTS

| | | |
|---|---|---|
| 1268247 | 5/1968 | Germany . |
| 424905 | 5/1967 | Switzerland . |

*Primary Examiner*—Z. R. Bilinsky
*Attorney, Agent, or Firm*—Katherine A. Nelson

[57] ABSTRACT

A low profile connector 20 including a receptacle 22 and a plug 70, each having a housing 24,72 with respective arrays of contacts 44,92 secured therein, the contacts 44,92 being of thin metal set on edge in the housings 24,72 and including edge contact surfaces 50,98 projecting from the housings 24,72 in a common plane for soldering to the circuits. Each receptacle contact 44 has a C-shaped configuration including a base 48, an intermediate portion 60 and an arm 62, the arm 62 defining a contact surface 68 adapted to mate with a corresponding plug contact surface 110, the arm 62 extending transversely of the axis in a first direction. Each plug contact 92 has an L-shaped configuration including a base 94 and a post 104 extending from the base 94 parallel to the axis, a side surface 110 of the post 104 defining a mating surface for a corresponding one of the receptacle contacts 44. Upon mating of the receptacle 22 and plug 70, the side surface of the post 104 of the plug contact 92 engages the arm 62 of the receptacle contact 44 in sliding engagement, deflecting the arm 62 transversely of the axis in a second direction, the post 104 co-extending past the arm 62 and in spring biased engagement therewith resulting in a low profile connector 20.

2 Claims, 8 Drawing Sheets

70
72
74
76
78
80
82
84
86
88
90
92
20
22
24
26
28
30
34
38
40
42
44

LOW PROFILE BOARD TO BOARD CONNECTOR

FIELD OF THE INVENTION

This invention relates to electrical connectors and more particularly to board to board electrical connectors for interconnecting circuits between parallel circuit boards.

BACKGROUND OF THE INVENTION

U.S. Pat. No. 5,199,884 discloses a blind matable miniature connector for interconnecting circuits between parallel circuit boards. The connector in this patent includes contacts placed on close center lines such as on the order 0.5 mm (0.020 inches) for high density interconnection. Spring design of the contacts, and the housings require a minimum height of about 5 mm (0.20 inches), which means that the boards to be connected can be no closer than 5 mm (0.20 inches) apart.

With the increased miniaturization of electronic equipment, such as small portable computers and the like it is desirable to have connectors that will allow circuit boards to be placed at lower stack heights on the order of 3.0 mm and 4.0 mm (0.118 inches to 0.157 inches). It is further desirable that the low profile connector contacts also provide for high density interconnections.

SUMMARY OF THE INVENTION

The present invention is a low profile board to board connector assembly including a plug and receptacle, each having respective housings and arrays of contacts of thin metal set on edge in the housing on center lines complementary to the center lines of the circuits on the printed circuit boards. The contacts include edge contact surfaces projecting from the housings in a common plane for soldering to the board circuits. The receptacle housing includes a floor, opposed side walls, and opposed end walls, together defining an interior cavity configured to receive the plug housing inserted therein. The housing floor has a plurality of contact receiving slots extending therethrough, each slot having a receptacle contact disposed therein. The receptacle contacts have a body with a C-shaped configuration and include a base, an intermediate portion and an arm, the base and arm extending essentially parallel to one another from the intermediate portion. The outward edge of the base defines the edge contact surface for engagement with a respective circuit on a circuit board and the intermediate portion and arm define a spring, the arm including a contact surface adapted to mate with a corresponding plug contact upon mating the receptacle and plug. The receptacle contact is disposed in the slot of the housing floor such that the board contact surface thereof is spaced outwardly from the outer major surface of the floor and the intermediate portion and arm extend into the interior cavity of the receptacle housing, the arm extending transversely of the axis of mating in a first direction. The arm is adapted to be deflected transversely of the axis of mating in a second direction by the corresponding plug contact when the receptacle and plug are mated.

The plug housing includes a floor having a plurality of cavity walls extending laterally across the interior surface of the floor and a plurality of contact receiving apertures extending through the floor. Each plug contact has an L-shaped configuration including a base and a transversely directed post extending from an interior edge of the base. The outer edge of the base defines an edge contact surface for engagement with a respective circuit of a circuit board and the post defines a mating surface for a corresponding one of the receptacle contacts. The plug contact is disposed in the plug housing such that the base portion extends along the outer surface of the floor and the post portion extends through the aperture into a contact receiving cavity adjacent a respective cavity wall. Upon mating the receptacle and plug, the post of the plug contact engages the contact surface of the spring arm of the receptacle contact in a sliding engagement, deflecting the spring arm in a direction transverse to the axis of mating. The post co-extends past the spring arm and is in spring bias engagement therewith resulting in a low profile connector thus minimizing board to board spacing. In the preferred embodiment the receptacle and plug contacts further include a plurality of grooves on at least one side thereof to prevent solder from being wicked up into the mating area when the connector is soldered to the circuit board.

The present invention also provides a means for adjusting the stacking height between parallel boards by providing another embodiment of the plug contact wherein the width of the base of the L-shaped member is selected to provide a desired stacking height.

It is accordingly an object of the present invention to provide improved board to board electrical connectors having low stack heights.

It is a further object of the invention to provide a low profile board to board connector assembly suitable for interconnecting circuits of the types on surfaces of parallel circuit boards having extremely close center lines between the circuits.

It is another object of the invention to provide a low profile connector assembly that will permit mating of the contacts even when the contacts of each matable pair are slightly misaligned with respect to each other, thereby permitting multiple arrays of rigidly mounted contacts in multiple connectors to be mated simultaneously thus defining an arrangement that compensates for tolerances.

It is also an object of the invention to provide a method for making contacts that are small but have a relatively large deflection range.

Embodiments of the invention will now be described by way of example with reference to the accompanying drawings.

DETAILED DESCRIPTION OF THE DRAWINGS

Figures 1, 2:
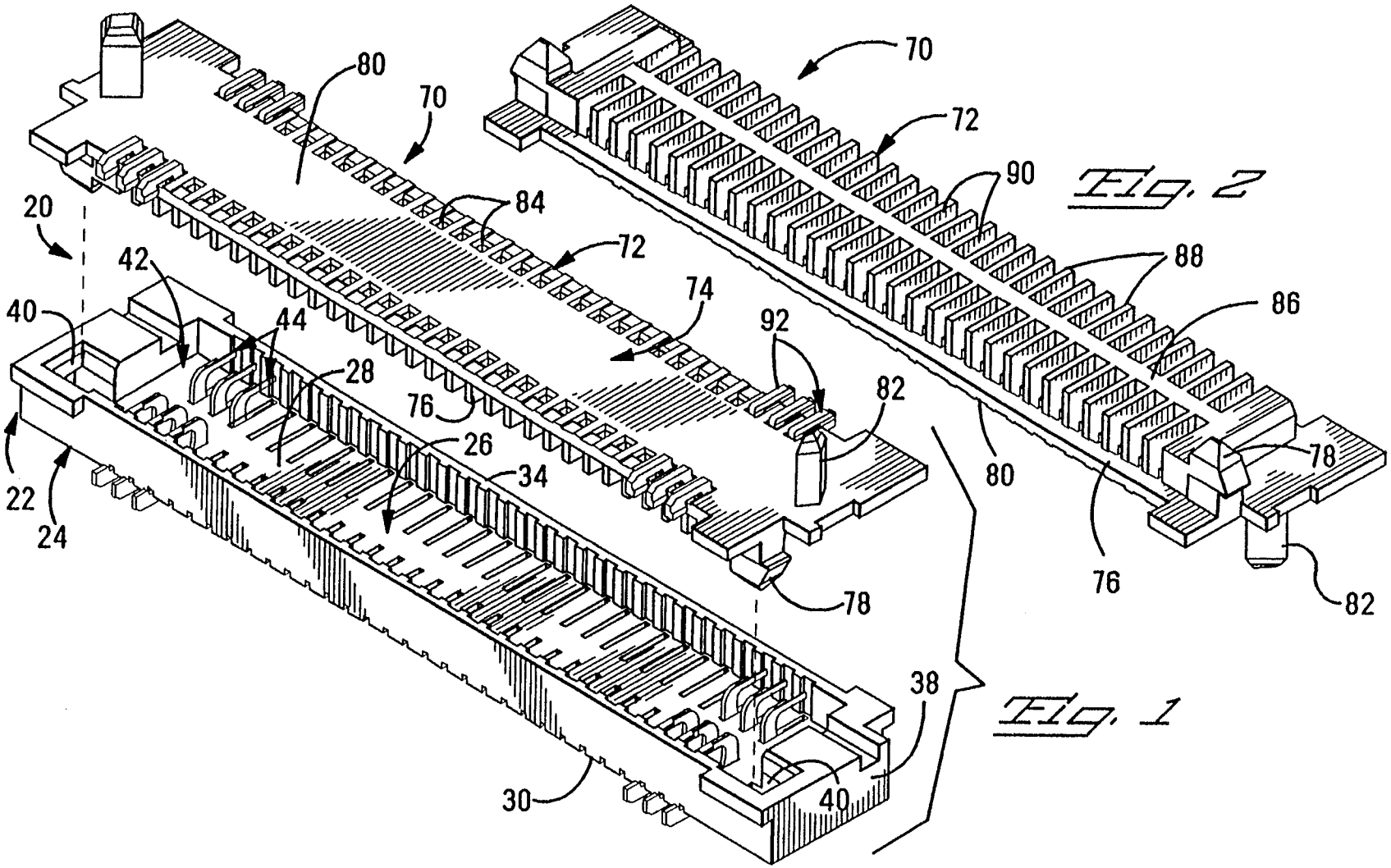
FIG. 1 is a perspective view of the connector assembly of the present invention, considerably enlarged, with the receptacle and plug exploded from each other.
FIG. 2 is a perspective view of the mating side of the plug housing.

Referring now to FIGS. 1, 2, 3 and 4 connector assembly 20 includes a receptacle 22 having a plurality of receptacle contacts 44 disposed therein and a plug 70 having a plurality of contacts 92 disposed therein. Receptacle 22 includes a housing 24 having a floor 26 having major inner and outer surfaces 28,30 respectively. Floor 26 further includes a plurality of contact receiving slots 32 extending therethrough between the inner and outer major surfaces 28,30. Receptacle housing 24 also includes opposed side walls 34 and opposed end walls 38, the floor 26, side walls 34 and end walls 38 together defining a cavity 42 configured to receive a portion of the plug 70 therein upon mating the receptacle 22 and plug 70. End walls 38 include apertures 40 for receiving guide pins 78 of the plug housing 72 when the receptacle 22 and plug 70 are mated.

Plug 70, as shown in FIGS. 1 through 4 includes a plug housing 72 having a floor 74 and opposed major surfaces 76 and 80 and a plurality of contact receiving apertures 84 extending through the floor 74. The inner surface 76 of floor 74 includes posts 78, which extend forwardly therefrom for engagement with corresponding apertures 40 in the receptacle housing 24 when the plug 70 is mated to receptacle 22. The outer surface 80 of floor 74 includes posts 82 for mounting plug 70 onto a circuit board 116 as can best be seen in FIGS. 4 through 6. The major inner surface 76 of floor 74 further includes a center wall 86 extending longitudinally therealong. A plurality of side walls 88 extend essentially perpendicular to the center wall 86 and between the respective apertures 84 and define internal open ended cavities 90 for receiving the mating portions of the respective receptacle and plug contacts 44,92 as more fully described below.

Receptacle and plug housings 24,72 respectively are preferably made from a high temperature resistant material such as a liquid crystal polymer or the like. The material selected must be able to withstand temperatures of about 250° C. that are typically achieved during a soldering process, such as infrared reflow soldering or other methods as known in the art.

Figure 10:
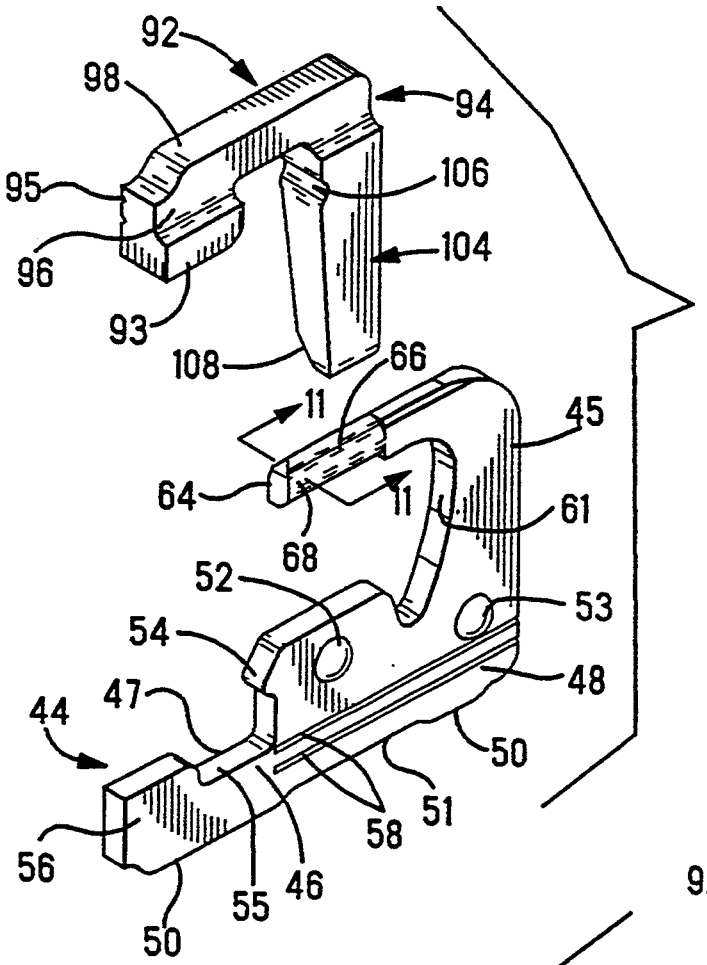
FIG. 10 is a perspective view of one side of the receptacle and plug contacts used in the embodiment shown in FIGS. 1–7.
Figure 12:
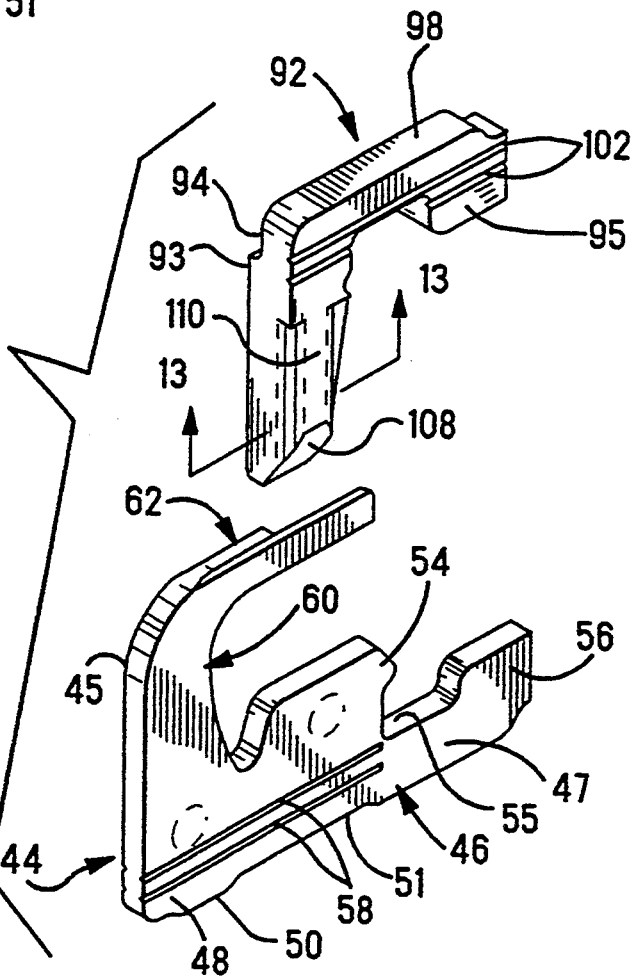
FIG. 12 is a view similar to that of FIG. 10 showing the other side of the receptacle and plug contacts.

Receptacle contacts 44 as best seen in FIGS. 10 and 12 have C-shaped bodies 46 having opposed major surfaces 45 and 47. Body 46 includes a base 48, intermediate portion 60 and an arm 62. Base 48 has an outer contact surface 50 for engaging corresponding circuit pads 114 on circuit board 112 as shown in FIGS. 4 through 7, and 16. Base 48 includes a plurality of dimples or protrusions 52,53 extending outwardly from major surface 45, which aid in positioning receptacle contact 44 within the corresponding slot 32. In the preferred embodiment the receptacle contact 44 is made from metal stock material having a thickness of approximately 0.15 mm (0.006 inches). The metal selected preferably has a high yield strength in the range of 105–125 thousand p.s.i. to assure that sufficient normal force is achieved in the mated assembly. The protrusions 52,53 aid in the absorbing the clearance within the slot 32 so that the other major surface 47 of the contact 44 is held flat against a wall within the slot 32. The position of protrusion 53, in particular, also influences the spring characteristics of spring arm 66 and determines the amount of stress transmitted to base 48.

Figures 4, 5:
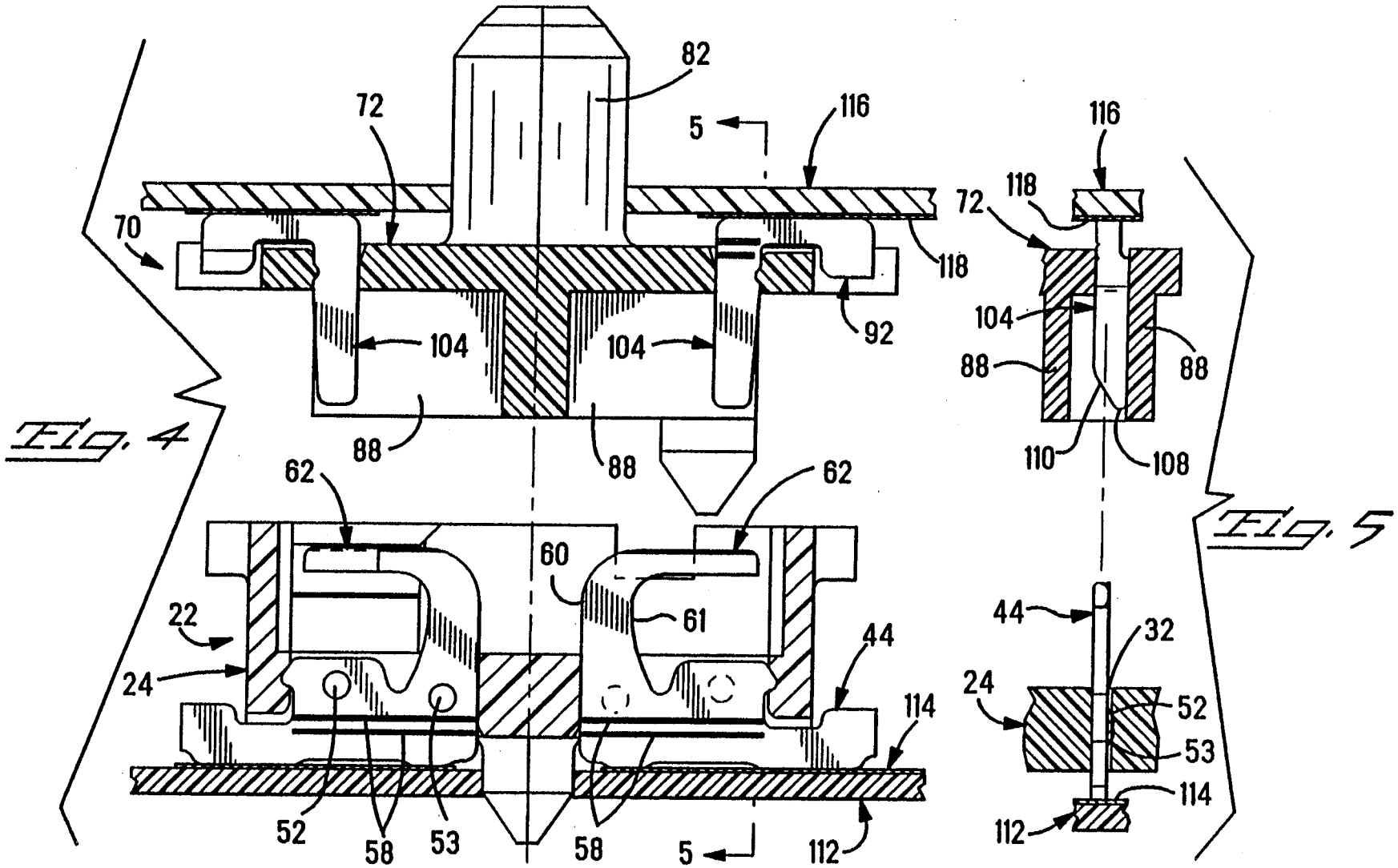
FIG. 4 is a cross-sectional view of the assembly showing the plug and receptacle mounted to respective circuit boards prior to mating of the receptacle and plug.
FIG. 5 is an end view taken along lines 5—5 of FIG. 4.
Figure 11:
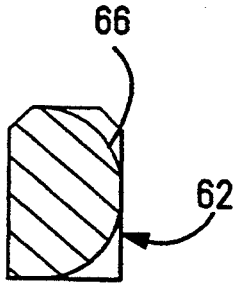
FIG. 11 is a sectional view taken along the line 11—11 of FIG. 10.
Figure 16:
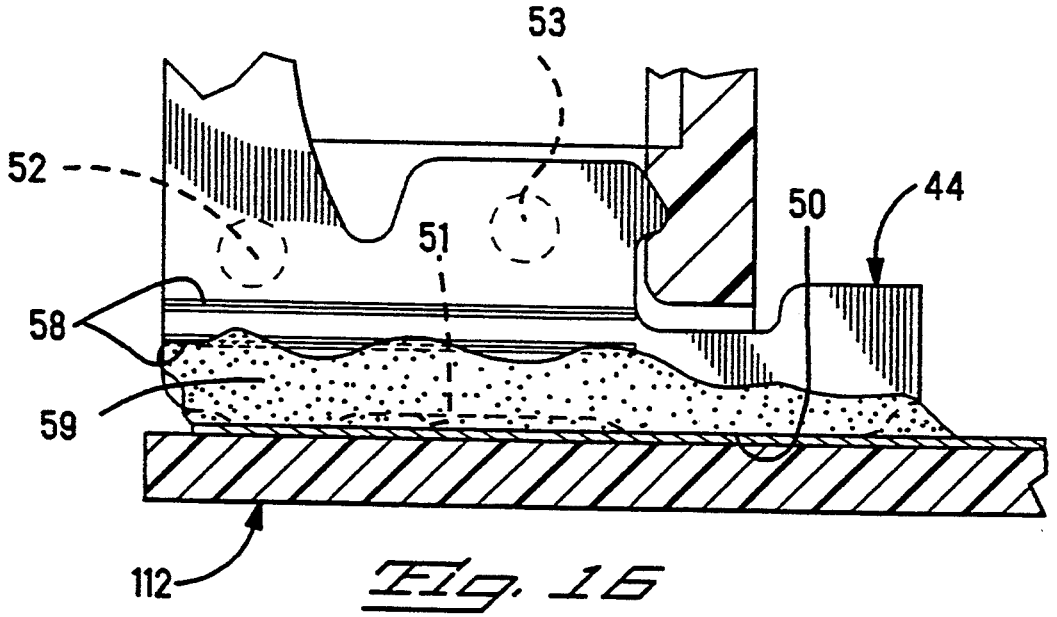
FIG. 16 is a fragmentary enlarged view of a receptacle contact soldered to a circuit pad on a circuit board.

Base 48 further includes a retention means 54 which engages the surface of receptacle housing 24 when contact 44 is disposed within the slot 32. Also seen in FIG. 4, when contact 44 is disposed within its respective slot 32, arm 62 and a portion of the intermediate portion 60 extend into the receptacle cavity 42. The base 48 of contact 44 further includes a short leg portion 56 having a groove 55 therein for receiving the side wall 34 therein. As shown in FIGS. 4, 10, 12 and 16 the base 48 further includes two grooves 58 on each side thereof that act to prevent the solder 59 from being wicked into the receptacle cavity, as shown in FIG. 16. To ensure a good solder joint with the circuit pad 114 on board 112, the outer edge 50 of contact 44 has an indentation 51 that allows a fillet of solder to spread beneath the thin edge of the contact 44 as seen in FIG. 16. The intermediate portion 60 includes an inner tapered edge 61. This tapering evenly distributes stresses along the length of portion 60 and arm 62, thus optimizing the spring characteristics of receptacle contact 44. The arm 62 is shorter than the base 48 and includes a radiused portion 66 from the leading end 64 and inwardly thereof as shown in FIG. 11. The radiused surface 66 provides a ramp and a contact surface 68 for engaging a corresponding contact surface 110 of the plug contact 92 when the receptacle 22 and plug 70 are mated, as is more fully described below. Referring now to FIGS. 4 and 5 the receptacle 22 is assembled by inserting C-shaped contact members 44 into the respective slots 32 of floor 26 from the outer surface 30 thereof such that the arm 62 extends into the cavity 42. As can be seen in FIG. 4, the lower portion of base 48 extends from the outer surface 30 of housing 24 with the slot 55 capturing the respective housing side wall 34, and the retention means 54 engages an inner wall surface. The protrusions 52,53, as can best be seen in FIG. 5, hold contact 44 against one of the walls of the slot 32. The solder wicking prevention grooves 58 lie approximate the outer surface 30 of floor 26. FIG. 4 also shows the receptacle 22 having its terminals 44 and outer edge contact surface 50 positioned on corresponding circuit pads 114 of circuit board 112. Contact 44 is shown soldered to the pad in FIG. 16, which also illustrates the function of grooves 58.

Figure 13:
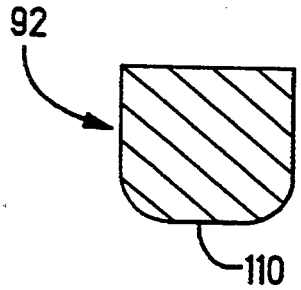
FIG. 13 is a sectional view taken along line 13—13 of FIG. 12.
Figure 14:
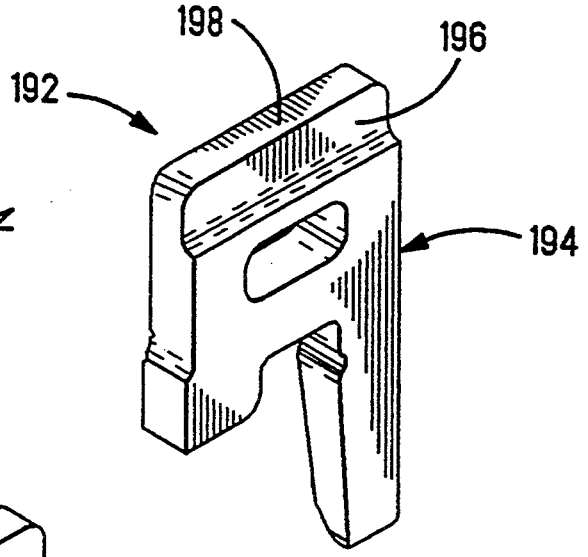
FIG. 14 is a perspective view of one side of the further embodiment of the plug contact made in accordance with the invention as shown in the embodiment of FIGS. 8 and 9.
Figure 15:
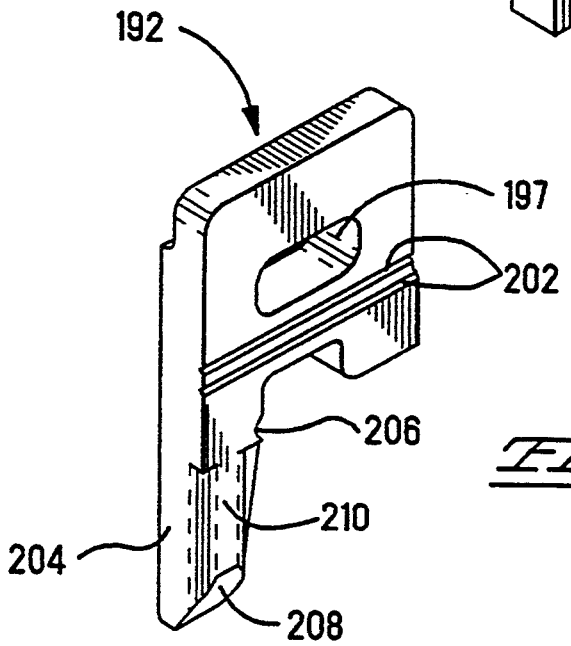
FIG. 15 is a view similar to that of FIG. 14 showing the other side of the plug contact.

As shown in FIGS. 10, 12 and 13, plug contacts 92 have an L-shaped configuration including a base 94 having an inner and outer surface 93,95 respectively and a transversely directed post 104 extending from an interior end thereof. The base 94 further includes a thinner area 96 which defines a thin outer edge contact surface 98 for engagement with a respective circuit 118 on a circuit board 116 as shown in FIGS. 4 through 7. Contact 92 is preferably made from metal stock such as phosphor bronze of the like having a thickness of approximately 0.32 mm (0.0126 inches), which preferably has reduced thickness of approximately 0.23 mm at 96 to provide the contact edge surface 98. The plug contact 92 further includes solder wicking prevention grooves 102 on one side thereof. Post: 104 includes a retention area 106 for holding the contact 92 within the housing floor 74 and has a radiused and tapered section 108 at the leading end thereof leading to the contact surface 110, as seen more clearly in FIGS. 10, 12 and 13.

The L-shaped plug contact 92 is assembled into the plug housing 72 by inserting the post 104 into respective apertures 84 from the outer surface 80 of floor 74 such that the base 94 of the contact lies against the outer surface 80 of housing 72 and the straight side of post 104 extends adjacent one of the side walls 88 and into cavities 90, as can be seen in FIGS. 4 and 5. The respective contacts 92 are secured in the plug housing by means of the retention feature 106 and essentially in an interference fit.

Figure 7:
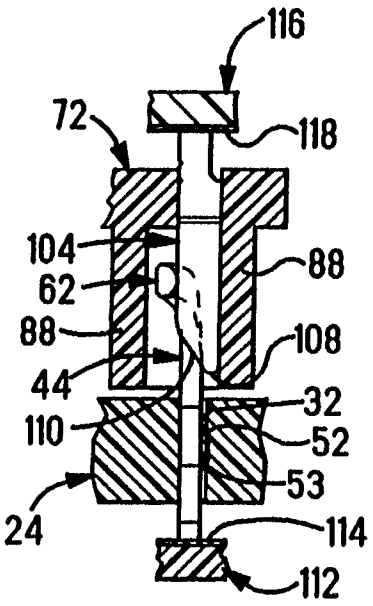
FIG. 7 is a view taken along lines 7—7 of FIG. 6.
Figure 6:
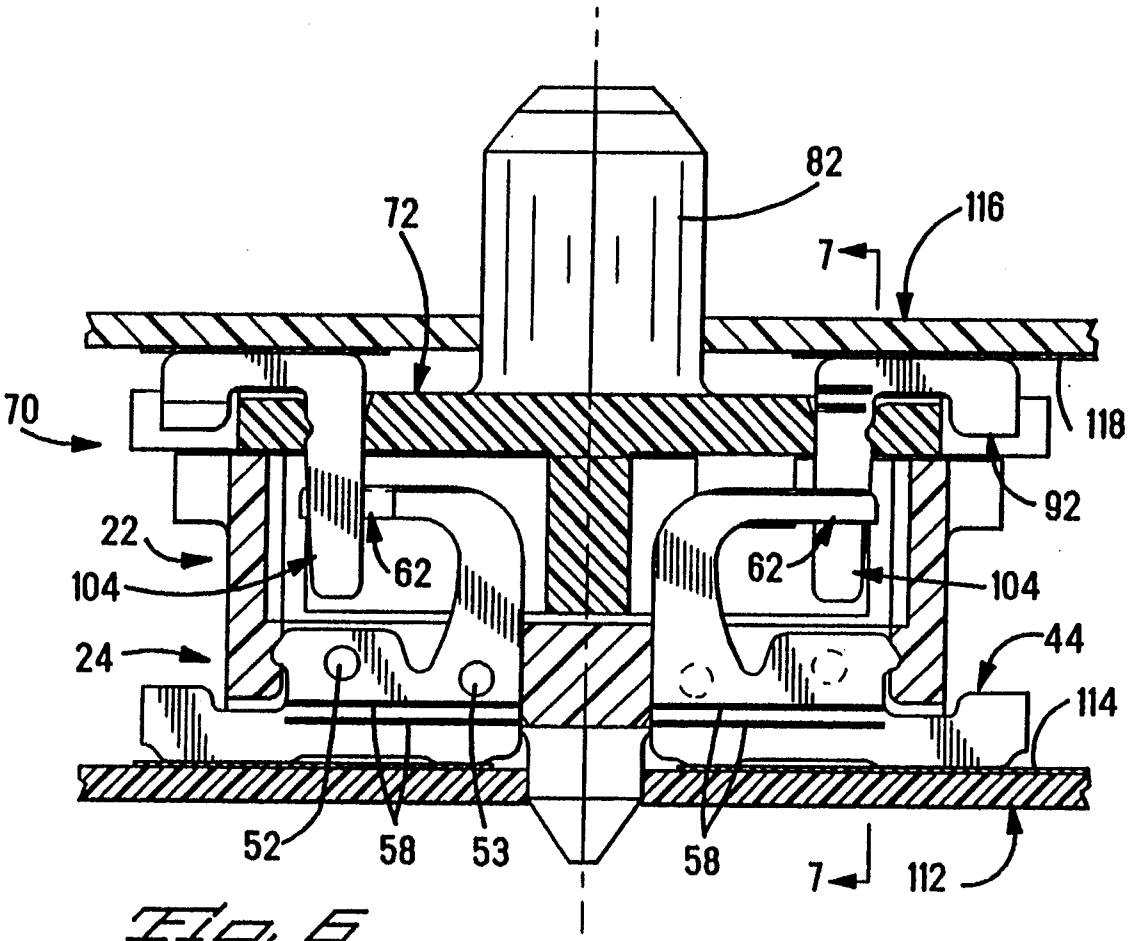
FIG. 6 is a cross-sectional view similar to that of FIG. 4 showing the receptacle and plug mated.

Upon mating the receptacle 22 and the plug 70, the lead-in surface 108 of post 104 of the plug contact 92 engages the corresponding contact surface 68 of the spring arm 62 of the receptacle contact 44 in sliding engagement therewith. As post 104 slides toward the floor of the receptacle housing 24 the surface 108 deflects the spring arm 62 in a direction transversely to the axis of mating. As the post 104 deflects the spring arm 62, the intermediate body portions 60 of the receptacle contact 44 twists thereby providing sufficient normal force between the two contact members. The amount of normal force can be controlled by adjusting the position of slot: 32 with respect to apertures 84 thereby determining the amount of deflection of spring arm 62. When the receptacle 22 and plug 70 are fully mated, the post 104 co-extends past the spring arm 62 and is in spring bias engagement therewith. The resulting assembly 20 has a low profile thus minimizing the board to board spacing as can be seen in FIGS. 6 and 7.

The configuration of the contacts 44, 92 and housings 22, 72 and the high deflection force of the contacts 44 provide a low profile connector assembly that will permit mating of the contacts 44, 92 even when the contacts 44,92 of each matable pair are slightly misaligned with respect to each other, thereby permitting multiple arrays of rigidly mounted contacts 44, 92 in multiple connectors 10 to be mated simultaneously, thus defining an arrangement that compensates for tolerances.

Figure 3:
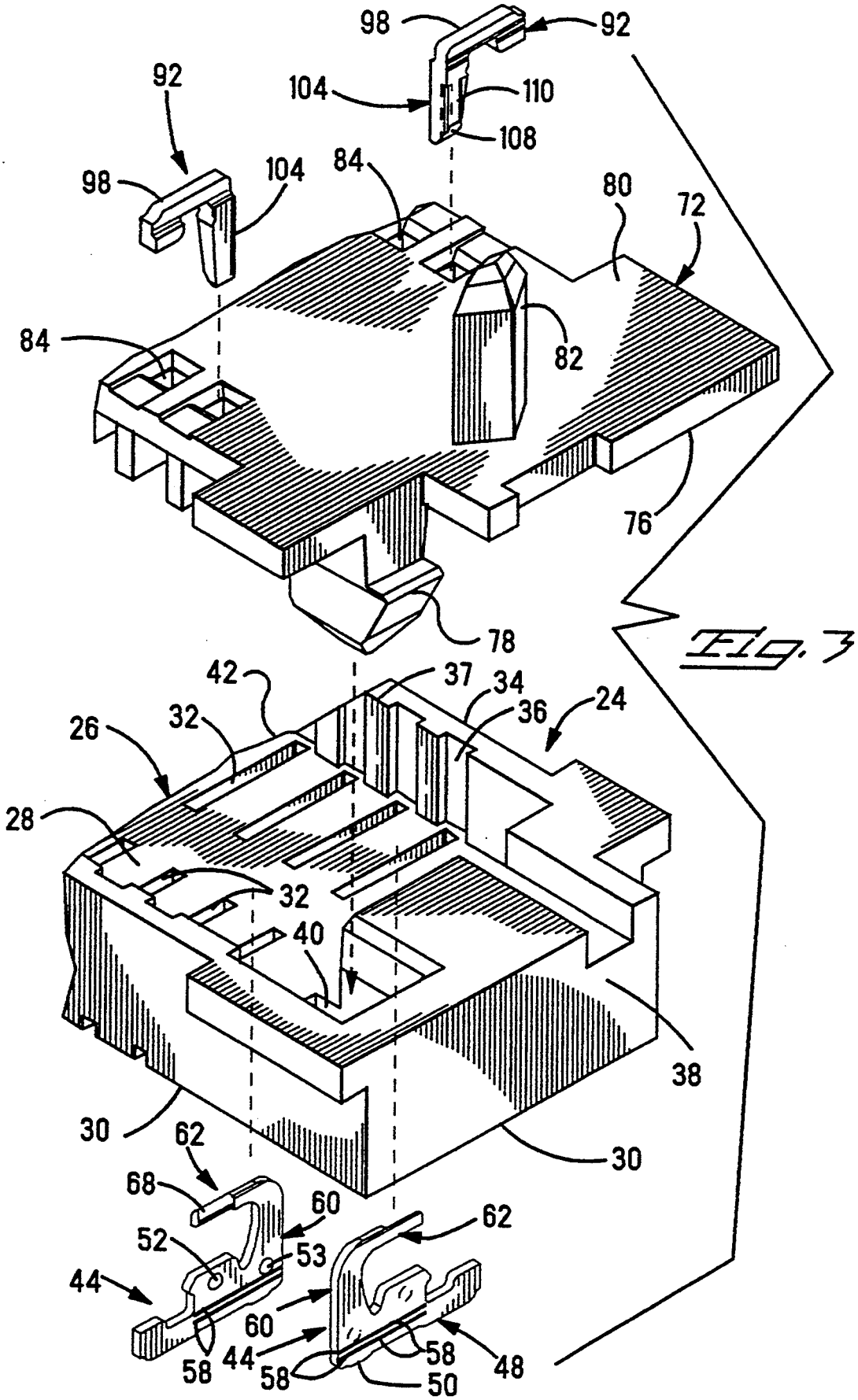
FIG. 3 is an enlarged fragmentary view of the connector assembly of FIG. 1 having the receptacle and plug contacts exploded from the respective housings.

As can be seen in FIGS. 10 and 12, the protrusions 52,53 are on only one side of the contact 44. Thus, when two rows of receptacle contacts 44 are inserted into housing 22, as shown in FIGS. 1 and 3, all the contacts 44 in the first row are thrown in a common first direction in their respective slots 32 and all the contacts 44 in the second row are thrown in a common second direction, opposed to the first direction. The shape of plug base 94 throws the plug contact 92 to one side of its respective aperture 84 as shown in FIGS. 1, 3 and 7. Thus the plug contacts 92 in the first row are thrown in a common direction opposite to that of the receptacle contacts 44 thereby enabling the corresponding contact surfaces 66, 110 to engage each other. In the same manner, the plug contacts 92 in the second row are thrown in a common direction opposite to that of the receptacle contacts 44 thereby enabling the corresponding contact surfaces 66, 110 to engage each other in the second row. By positioning the contacts 44,92 in the two rows so that the contacts 44 therein are deflected in opposing directions, torque generated in one row by the twisting of the receptacle contacts 44 during mating is cancelled out: by the torque generated in the opposite direction by the contacts 44 in the other row.

Figure 8:
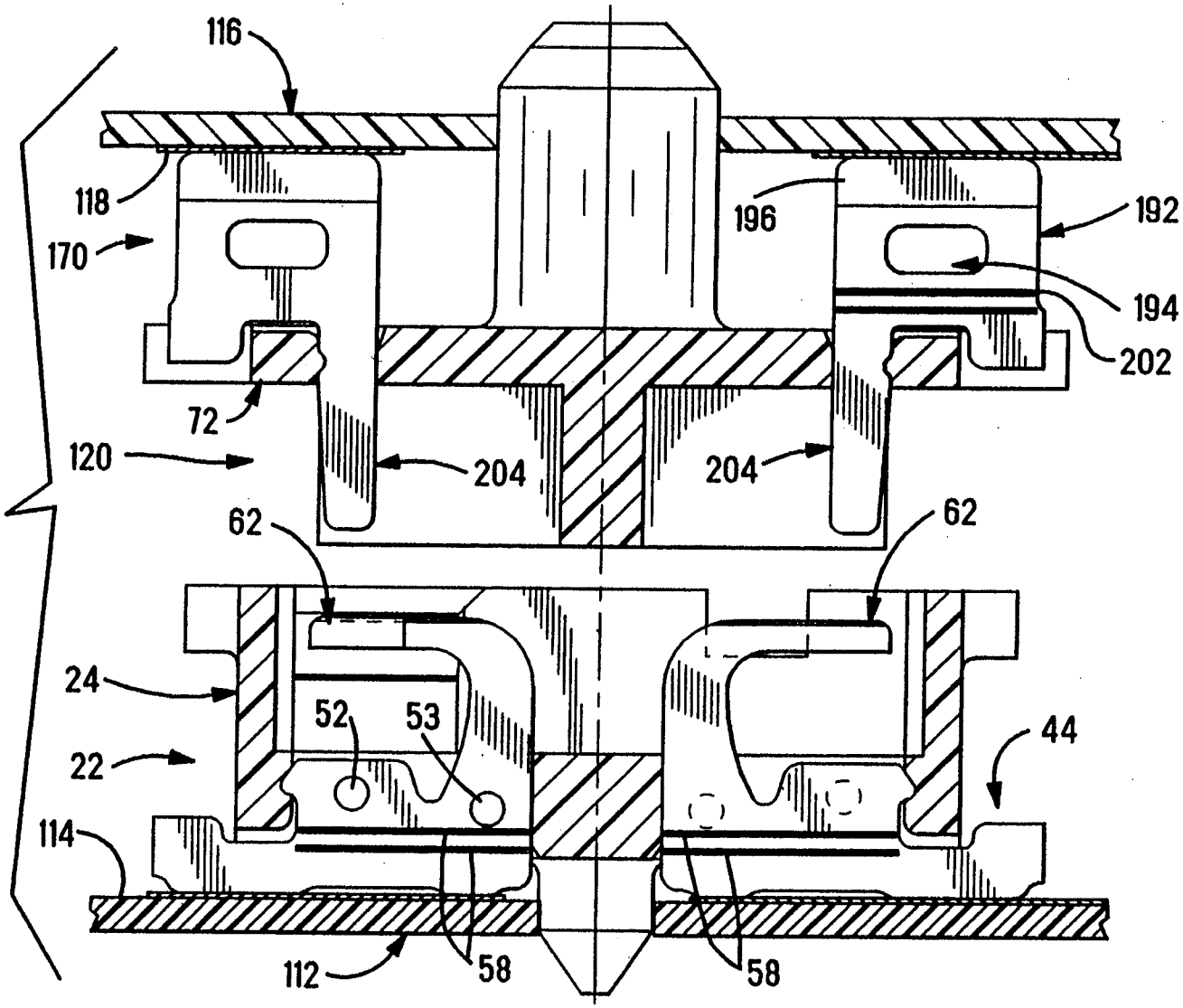
FIG. 8 is a view similar to FIG. 4 illustrating a receptacle and plug having a higher stack height than the one shown in FIGS. 4–7.
Figure 9:
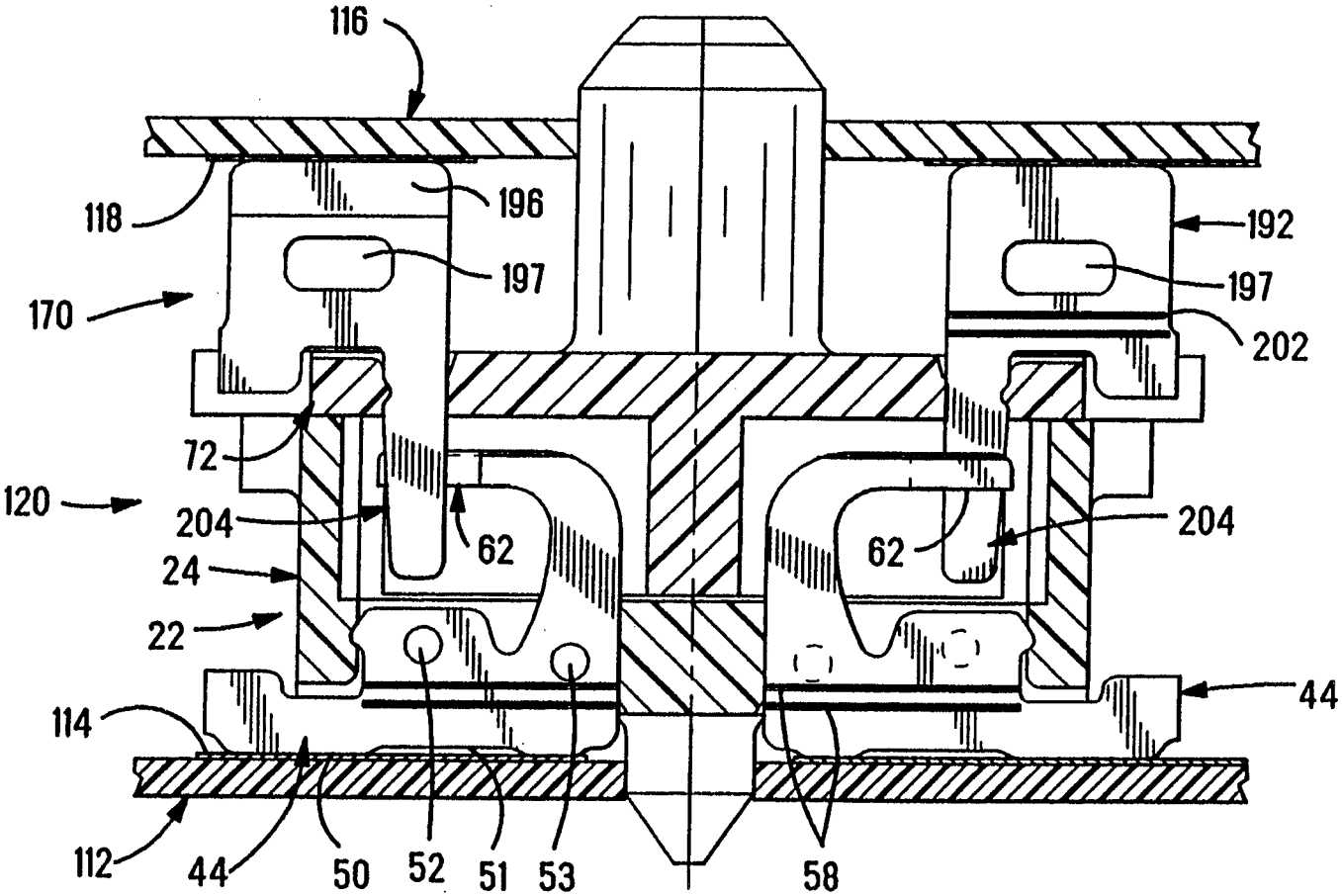
FIG. 9 is a view similar to FIG. 8 showing the mated connector assembly.

FIGS. 8, 9, 14 and 15 illustrate the present invention using another embodiment 192 of the plug contact in which the contact base 194 is wider thereby providing a greater stack height between the parallel circuit boards when the connector 120 is assembled. The base 194 of the L-shaped base of contact 192 includes the thinned area 196 and the corresponding grooves 202 to prevent solder wicking in the same manner as previously described. To reduce the capacitance of the contact 192 the floor portion 194 may further include an aperture 197 as can be seen in the above Figures. FIG. 8 illustrates connector assembly 120 prior to mating and FIGS. 9 illustrates the assembly 120 after mating.

It is thought that the electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A low profile board to board electrical connector for interconnecting circuits on close centers on surfaces of respective circuit boards including receptacle and plug housings, each having arrays of contacts secured therein defining a receptacle and plug, said contacts being of thin metal set on edge in said housings on centerlines complementary to the centerlines of the circuits and including edge contact surfaces projecting from said housings in a common plane for soldering to said circuits;

said receptacle housing including a floor having major inner and outer surfaces, opposed side walls and opposed endwalls together defining an interior cavity configured to receive said plug housing inserted therein along a given axis, said floor having a plurality of contact receiving slots extending therethrough, each slot having a receptacle contact disposed therein;

each of said contacts of said receptacle having a body having a C-shaped configuration and including a base, an intermediate portion and an arm, the base and arm extending outwardly from said intermediate portion, the outer edge of said base defining said edge contact surface for engagement with a respective circuit on a circuit board and said arm defining a contact surface adapted to mate with a corresponding plug contact upon mating of said receptacle and plug, said receptacle contact being disposed in a respective said slot of said housing floor such that said board contact surface thereof is spaced outwardly from the outer major surface of said floor and said intermediate body portion and said arm thereof extend into said interior cavity of said receptacle housing, said arm extending transversely of said axis in a first direction, said arm being adapted to be deflected transversely of said axis in a second direction by said plug contact when said receptacle and plug are mated;

said plug housing including a floor having major inner and outer surfaces and a plurality of contact receiving apertures extending therethrough, each aperture having a plug contact extending therethrough;

each plug contact having an L-shaped configuration including a base having outer and inner edges and a post extending from the inner edge of said base parallel to said axis, the outer edge of said base defining said edge contact surface for engagement with a respective circuit on a circuit board, and a side surface of said post defining a mating surface for a corresponding one of said receptacle contacts, whereby upon mating of said receptacle and plug, said side surface of said post of said plug contact engages said arm of said receptacle contact in sliding engagement, deflecting said arm in a direction transverse to said axis of mating, said post coextending past said arm and in spring biased engagement therewith resulting in a low profile connector thus minimizing board to board spacing.

2. The low profile board to board electrical connector of claim 1 wherein said receptacle includes two rows of receptacle contacts, all of the contacts in the first row being thrown in a common first direction in their respective slots and all the contacts in the second row being thrown in a common second direction in their respective row, and said plug includes two rows of plug contacts, the contacts of each of said plug rows being thrown in a common direction opposite to the direction of the corresponding row of mating receptacle contacts thereby enabling corresponding said receptacle and plug contact surfaces to engage when said receptacle and plug are mated.

* * * * *